United States Patent [19]

Huang

[11] Patent Number: 4,494,817

[45] Date of Patent: Jan. 22, 1985

[54] FEEDER CONNECTOR ASSEMBLY FOR COAXIAL CABLE

[76] Inventor: Chi-Hao Huang, No. 4, Kuo Sheng Li, Chang Hua, Taiwan, 500

[21] Appl. No.: 522,578

[22] Filed: Aug. 12, 1983

Related U.S. Application Data

[63] Continuation-in-part of Ser. No. 357,797, Mar. 12, 1982.

[51] Int. Cl.[3] ..... H01R 17/18

[52] U.S. Cl. ..... 339/177 R; 339/147 R; 333/260

[58] Field of Search ..... 339/147 R, 177 R, 177 E; 333/32, 260

[56] References Cited

U.S. PATENT DOCUMENTS

| | | | |
|---|---|---|---|
| 3,316,453 | 4/1967 | Lassers | 339/17 C |
| 3,327,253 | 6/1967 | Campbell | 333/32 |
| 3,989,333 | 11/1976 | Cauldwell | 339/17 C |

OTHER PUBLICATIONS

Fordham Radio Catalog, 1983, p. 175, 260 Motor Parkway, Hauppauge, NY 11788.

*Primary Examiner*—Eugene F. Desmond
*Assistant Examiner*—Steven C. Bishop
*Attorney, Agent, or Firm*—Armstrong, Nikaido, Marmelstein & Kubovcik

[57] ABSTRACT

This invention relates an improved structure of a coaxial feeder connector especially one having a hook shaped spring leaf directly connected with a safety sleeve, and having a threaded tube body formed as an integral part of the safety sleeve so that even under omission of the connector body, the special function of the feeder connector can still be achieved and that the feeder connector will be simpler in manufacturing, faster in processing, higher in efficiency and lower in cost.

2 Claims, 13 Drawing Figures

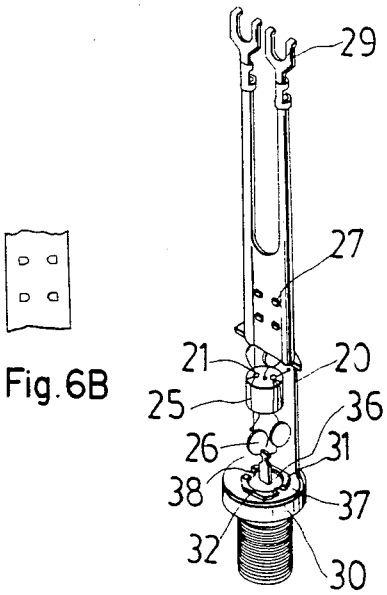
Fig. 6A
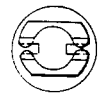
Fig. 6B
Fig. 6C
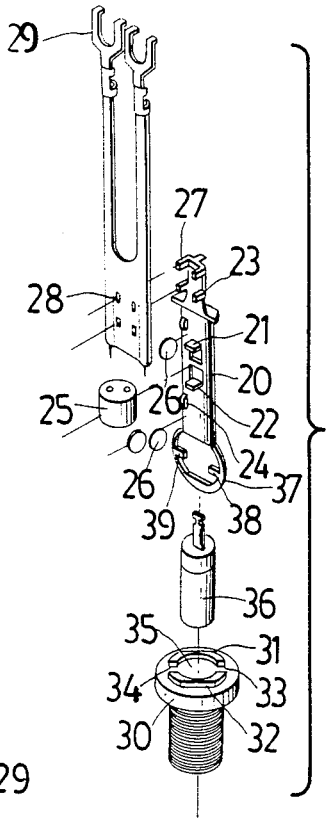
Fig. 5.
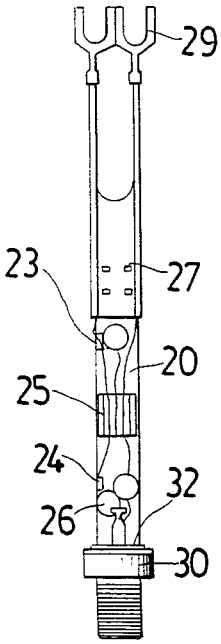
Fig. 7.

FEEDER CONNECTOR ASSEMBLY FOR COAXIAL CABLE

CROSS REFERENCE TO RELATED APPLICATION

This application is a continuation-in-part of Ser. No. 357,797, filed Mar. 12, 1982.

BACKGROUND OF THE INVENTION

As shown in FIG. 1 and FIG. 2, the structure of the conventional coaxial cable feeder connector comprises a printed insulating base plate 2, soldered to the upper edge of the connector body 1, and a top part 9 of the contact point spring leaf protruding from the hollow part of the connector body 1. The structure further includes a converter consisting of three capacitors 4, one transformer 5, a twin lead feeder terminal 7 and contact point 6, soldered to the base plate 2 so that the coaxial cable feeder can be converted to a twin lead type cable feeder. Two sets of protruding ends 3 are formed on the connector body 1 to serve as a socket for receiving the two-pin part 10 of the base plate 2, and one of the pins is soldered to the set of protruding ends. A safety sleeve 8 is fitted over the feed connector to protect it from being damaged. In this prior art of structure, because the two-pin part 10 of the base plate 2 is fastened only by means of two sets of protruding ends 3, and since only one of the pins is to be soldered to a set of protruding ends, it is not solid enough and it is easy to shake, especially when the connected feeder is tripped or treaded by someone, and the base plate 2 will be shaken violently, and the pin pulled with the feeder may be broken or may fall off. The result is an open circuit, which requires frequent repairing, soldering or replacement. This is very troublesome.

To eliminate the above mentioned disadvantages, the inventor has studied and improved the feeder connector and completed the invention as shown in FIG. 3 and FIG. 4. This invention relates a printed insulating base plate 12, having two notches at two sides of its lower end, and having a metallic coating applied in the vicinity of the two notches for soldering purpose. On the upper edge of the connector body 11, two ⊔ shaped protruding pieces 13 are formed to serve as slots for the end of the base plate 12 which has two notches 18, so that the base plate 12 will not shake. The top part 19 of the contact point spring leaf of the connector body 11 is in contact with the center of the lower end of the base plate 12, and is soldered with a tin solder.

The former of the above mentioned two types is conventional and the latter is the one which has previously been improved by the inventor. However, the two types use a similar printed insulating base plate for the purpose of avoiding the influence of magnetic flux on the transformers 5 and 15 causing lower efficiency in receiving signals, if metallic base plate is used. In fact, according to the result of the experiments conducted in recent years and the experience obtained during practical usage by the inventor, the above mentioned point of view still has to be corrected. The reason why the efficiency in receiving signals will be lowered is due to the error of fixing positions of the elements including transformers 5 and 15 and capacitors 4, 14 as well as due to the error of the fixing method, not due to the material of the base plate. When the conventional printed base plate is used, it is necessary to first drill holes in the base plate. The elements are arranged according to their respective positions, and then are soldered in position. The soldering operation is time-consuming and exhausting work. In case of even the slightest deviation from the right position on the part of the operator, it is possible to make a positioning error, which affects the receiving efficiency. For this reason, the above mentioned two types of feeder connector cannot meet the strict requirements. Furthermore, when the printed insulating base plate is used, the place to be soldered should be first coated with a metallic coating to serve as the base layer for soldering. This will increase the processing procedure and eventually its cost. Since most of such small parts are manufactured in mass production, the slightest increase in unit cost will make a significant difference in total cost.

Not long ago, the inventor studied, designed and improved again, and a patent application was filed on Mar. 12, 1982 in the U.S. Patent Office with the application Ser. No. 357,797. The structure set forth in this patent application is shown in FIG. 5, FIGS. 6A, 6B, 6C and FIG. 7, in which the metallic base plate 20, having a clip-like opening formed by upper and lower clip-leafs 21, 22 are situated at a specific position on the metallic base plate 20 to fix the transformer 25. The clip leafs 21 and 22 are made by punch molding. In addition, two protrusion holes 23 and 24, formed on the sides of the base plate 20, can be used to hold the capacitors 26 to correctly position them. The top part of the base plate 20 is also formed with a protruding rod 27 during the same punching operation. This rod 27 can be directly inserted into the perforated hole 28, and then by means of pressing, the end of the rod 27 can be made flush with the feeder in order to fix the position for the two ends 29. The bottom part of the base plate 20 is made into a loop 37. After the contact point spring leaf 36 is put into the hole 35 in the body 30, the two protruding rods 38 and 39 within the loop 37 can mesh with two flanges 31 and 32 on the top surface of the body 30, and can be put into the two notches 33 and 34 between the two flanges 31 and 32. By means of the pressing operation the body of the flanges 31 and 32 near the two notches can be lowered so that two protruding rods 38 and 39 of the loop 37 of the base plate 20 will be firmly squeezed in the notches, and the contact point spring leaf body 36 can also be fixed in the hole 35.

From what has been described above, it shows that although the U.S. patent application Ser. No. 357,797 has overcome some problems of the conventional and improved feeder connectors, and thus is capable of reducing the time-consuming procedure of soldering, saving the time required for processing and avoiding the consideration of the possibility of damaging the connection between the base plate element and connector body, as a matter of fact, the patent application Ser. No. 357,797 still has some disadvantages. Specifically, the processing procedure has not been simplified to the utmost, and the manufacturing cost is still not minimized. This causes slow processing and extra expenses. These are the difficulties which cannot be overcome.

SUMMARY OF THE INVENTION

The purpose of the present invention is to provide a kind of improved structure for a feeder connector, which is an improved design based upon the structure proposed by previous U.S. patent application Ser. No. 357,797, in which the two elements, the metallic base plate and the safety sleeve, are to be used in order to keep the various advantages included in this U.S. patent application. Besides, this invention is characterized by making the connector body substantially easier to be processed and manufactured, and actually reducing the manufacturing cost by 20%.

BRIEF DESCRIPTION OF THE DRAWINGS

FIG. 5 illustrates the feeder connector of U.S. patent application Ser. No. 357,797 not including a safety sleeve.

FIGS. 6A, 6B and 6C are a perspective view and details of the feeder connector of the U.S. patent application Ser. No. 357,797 not including a safety sleeve.

FIG. 7 is the front view of the feeder connector of U.S. patent application Ser. No. 357,797 not including a safety sleeve.

DETAILED DESCRIPTION

Figure 1:
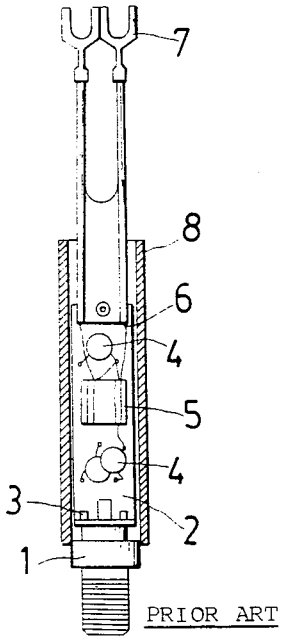
FIG. 1 is a section of part of a conventional feeder connector including a safety sleeve.
Figure 3:
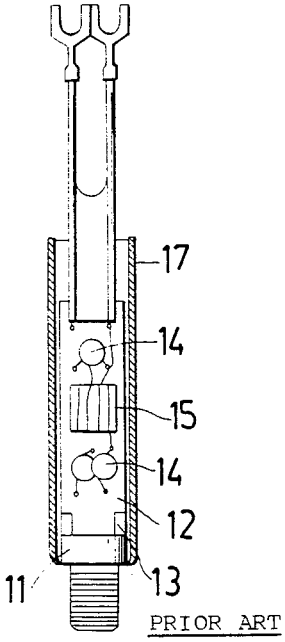
FIG. 3 is a section of part of an improved feeder connector including a safety sleeve.
Figure 2:
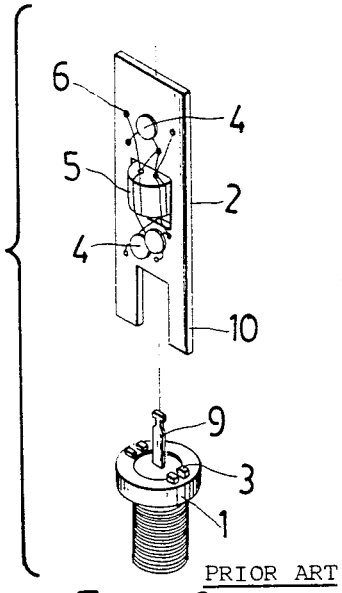
FIG. 2 illustrates a part of the conventional feeder connector not including a safety sleeve.
Figure 4:
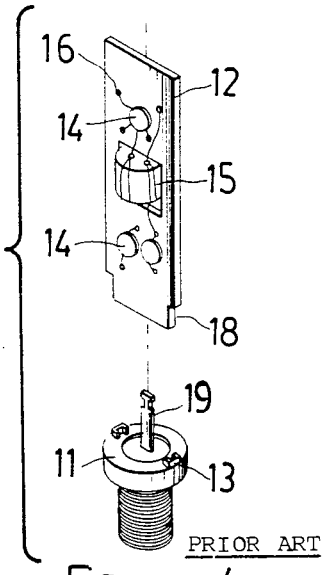
FIG. 4 illustrates a part of the improved feeder connector not including a safety sleeve.
Figure 8:
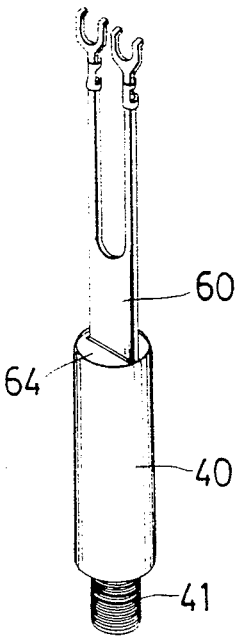
FIG. 8 is the perspective view of the feeder connector of the present invention.
Figure 9A:
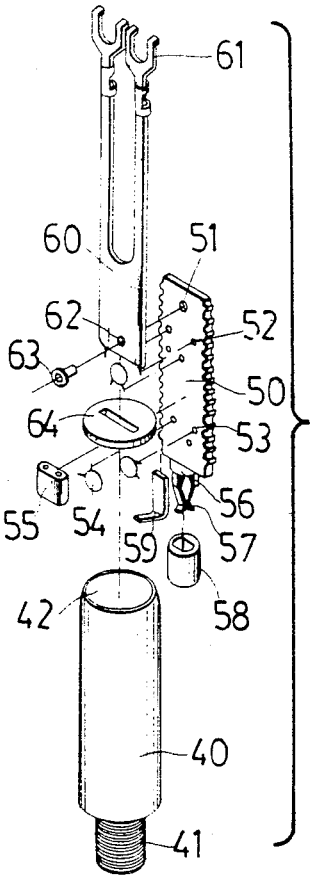
FIGS. 9A and 9B illustrate the elements of the present invention.
Figure 9B:
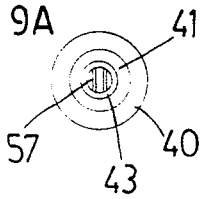
Figure 10:
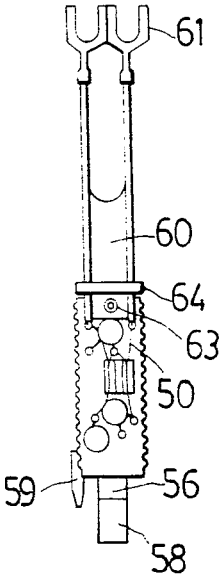
FIG. 10 is the front view of the feeder connector of the present invention with the safety sleeve removed.

Referring now to FIG. 8, FIGS. 9A, 9B and FIG. 10, the present invention is described in detail as follows:

Several circular holes are formed in the base plate 50, among which, the holes 52 and 53 are used for soldering three capacitors 54 and one transformer 55. The twin lead feeder 60 with two terminals 61 passes through the top plug piece 64 and is positioned with its hole 62 in alignment with the hole 51 on the base plate 50. The feeder 60 and base plate 50 are fastened together by means of a rivet 63. The structure of this part, except for the top plug piece 64, is the same as that of the conventional type feeder, and will not be described herein.

The new design of the structure of the present invention is that there is a clip 56, at the bottom end of the base plate 50, and within this clip, there are two wedge clip guide pieces 57 which are soldered rigidly to the base plate 50 and extend therefrom. This clip 56 can be fitted over by the member 58, and a hook shaped spring leaf 59 is soldered to one side of the bottom end of the base plate 50. Furthermore, the safety sleeve 40 is also re-designed at its bottom end with a threaded tube body 41 formed as an integral part of the safety sleeve 40. The threaded tube body 41 is hollow and threaded. The assembled base plate is positioned in the receiving hole 42 of the safety sleeve 40, and the top plug piece 64 is sealed at the receiving hole 42, in order to fix the base plate 50 in the safety sleeve 40.

In the above structure, the hook shaped spring leaf 59 is tightly pressed against the inside wall of the receiving hole 42 of the safety sleeve. Further, the body 58 is inside the threaded tube body 41. The two guide pieces 57 are in an exposed position in the bottom tube opening 43 of the threaded tube body 41.

Due to the new design of the hook shaped spring leaf 59 and the improved design of the safety sleeve 40 and the threaded tube body 41, the unnecesary operation of manufacturing and assembling the connector body can be totally avoided. Thus, the process of manufacturing the feeder connector can be further simplified, and the manufacturing cost reduced by 20%. Therefore, the successful development of this invention has made great contribution to the manufacture and end-user of this kind of feeder connectors.

What is claimed is:

1. A feeder connector comprising a base plate;

a hollow safety sleeve having a threaded portion integrally formed on one end thereof, said plate being positioned within said safety sleeve;

a plug piece fitted on the other end of said safety sleeve;

a twin lead feeder passing through said plug piece such that a portion thereof is positioned within said safety sleeve, the portion of said twin lead feeder within said safety sleeve being fixed to said base plate;

clip means fixed to said base plate, said clip means including wedge clip guide pieces;

a body means, said wedge clip guide pieces engaging said body means; and a hook shaped leaf spring means fixed to said base plate, said leaf spring means being pressed against the inside wall of said safety sleeve.

2. The feeder connector of claim 1 wherein said twin lead feeder is riveted to said base plate.

* * * * *